United States Patent [19]

Lukasiewicz

[11] Patent Number: 4,878,672

[45] Date of Patent: Nov. 7, 1989

[54] GOLF CLUB WITH SWING SPEED INDICATOR

[75] Inventor: Robert F. Lukasiewicz, Hinsdale, Ill.

[73] Assignee: Ram Golf Corporation, Melrose Park, Ill.

[21] Appl. No.: 220,374

[22] Filed: Jul. 11, 1988

Related U.S. Application Data

[62] Division of Ser. No. 53,612, May 26, 1987, abandoned.

[51] Int. Cl.[4] ..... A63B 69/36

[52] U.S. Cl. ..... 273/186 A; 273/77 R; 273/80 D; 273/80.1

[58] Field of Search ..... 273/186 A, 186 R, 193 R, 273/194 R, 183 D, 186 R, 77 R, 80 D, 80.1

[56] References Cited

U.S. PATENT DOCUMENTS 1,039,491 9/1912 Collins et al. ..... 273/186 A
1,492,039 4/1924 Leven ..... 273/186 A

FOREIGN PATENT DOCUMENTS 255850 8/1963 United Kingdom ..... 273/186 A

*Primary Examiner*—George J. Marlo
*Attorney, Agent, or Firm*—Jones, Day, Reavis & Pogue

[57] ABSTRACT

A fitting golf club for determining the flexibility of a golf club shaft, the club including an elongated shaft having one shaft end portion adapted to be grasped in a person's hands and an opposite shaft end portion with a golf club head attached. An indicia bearing screw head is adjustable between a plurality of different positions. Mechanisms associated with the adjustable head are operative responsive to the centrifugal force applied upon swinging of the fitting golf club. The mechanisms include a weight pivotally mounted within the head on an axis perpendicular to the shaft and parallel with the swing direction, the weight being movable between an armed position adjacent the upper side of said head to a released position adjacent the lower side of said head. The optimum shaft flexibility for the person being tested is determined by the position of adjustment of the adjustable head when compared with the time of release of the weight.

5 Claims, 2 Drawing Sheets

GOLF CLUB WITH SWING SPEED INDICATOR

This application is a division of application Ser. No. 53,612, filed on May 26, 1987 and now abandoned.

BACKGROUND OF THE INVENTION

This application relates to the art of golf clubs and, more particularly, to the art of fitting a person for desired qualities in a set of regular golf clubs.

Golf clubs are typically manufactured in a variety of standard types. For example, any given brand of golf clubs may be stocked with shafts of either stiff or regular flexibility, and with heads of flat, medium or upright lies. Customized golf clubs are also available with special features, such as shorter or longer shafts than standard types, and shafts of higher flexibility or stiffness than standard types.

A golf club head provides optimum performance when the center of the head sole is parallel to the surface on which the ball rests, and tangent to the bottom surface of the ball, at the moment of head impact with the ball. When club lie and shaft length are correctly fitted to an individual golfer's swing plane, optimum performance of the club head is achieved.

A main objective in golf is the transfer of the maximum amount of energy from a golfer's swing to the head of the club at the moment of impact with the ball. Accomplishing this objective requires the correct shaft flex in the golf club. The most important factor in determining correct shaft flex is the speed of the golfer's swing. For every head speed, there is a different optimum shaft flex. If the optimum shaft flex is not used, the golfer is not maximizing his full swing potential.

It would be desirable to have simple arrangements for determining the optimum golf club lie, shaft length and shaft flexibility for each individual person. This would make it possible for a golf pro to determine whether a particular golfer should be fitted with clubs of a standard type, or clubs with standard and customized features.

SUMMARY OF THE INVENTION

Optimum qualities of variable golf club characteristics are determined for each person. A fitting golf club is held by a person, and manipulated the manner of a regular golf club for determining an optimum quality of at least one variable characteristic.

The variable characteristics whose optimum qualities are determined may include club lie, shaft length and shaft flexibility.

In accordance with the present application, a fitting golf club has a variable lie and shaft length. The fitting golf club is held by a person like a regular golf club, and the person adopts a stance for addressing a golf ball. While in such stance, the club lie and shaft length are determined for use in providing a regular set of golf clubs to the person.

In one arrangement, the head and shaft of the fitting golf club are pivotally connected to one another for varying the club lie. Indicating means may be provided for indicating the adjusted lie. The indicating means may include a pointer on the shaft cooperating with indicia on the head toe.

The shaft length may be variable by providing an elongated socket in the lower end of the shaft for telescopically receiving an elongated rod attached to the head. Indicating means may be provided between the shaft and rod for indicating the adjusted length of the shaft.

A swing speed determining golf club includes a club head having swing speed determining means mounted on the head for determining the approximate speed at which the club is swung. The swing speed determining means may take many forms, and in one arrangement, the swing speed determining means is in the form of a mechanism movable between armed and released positions. The mechanism responds to centrifugal force of a predetermined magnitude for movement to its released position. Adjustment means may be provided for adjusting the mechanism to vary the magnitude of the centrifugal force required for moving same to its released position. The mechanism may include a movable weight releasably held in its armed position by a yieldable means.

A golfer is provided with the fitting clubs, and adopts a stance for addressing a golf ball to determine the optimum club lie and shaft length. Before or after determination of optimum club lie and shaft length, the golfer swings the swing speed determining club for determining the swing speed. These qualities are then used for providing the golfer with a set of regular golf clubs of a standard type, or with clubs having a combination of standard and customized features.

It is a principal object of the present invention to provide an improved apparatus and method for fitting golf clubs.

It is also an object of the invention to provide an improved fitting golf club for determining optimum club lie and shaft length.

It is an additional object of the invention to provide an improved fitting golf club for determining optimum shaft flexibility or stiffness.

It is another object of the invention to provide such fitting golf clubs which are economical to manufacture, and simple to use.

DESCRIPTION OF PREFERRED EMBODIMENTS

Figure 1:
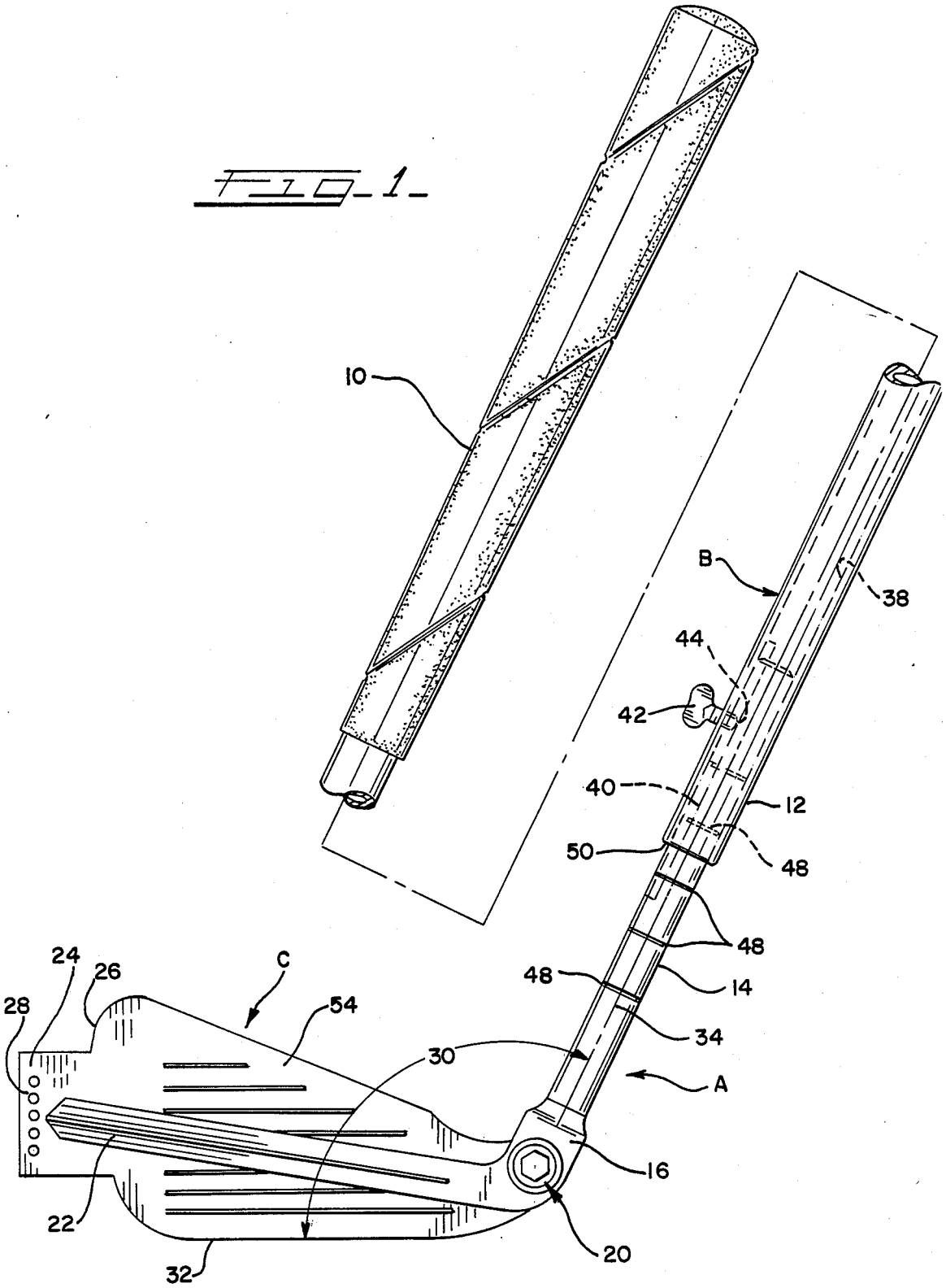
FIG. 1 is a front elevational view of a fitting golf club constructed in accordance with the present application.

Referring now to the drawing, wherein the showings are for purposes of illustrating preferred embodiments of the invention only, and not for purposes of limiting same, FIG. 1 shows a fitting golf club A having an elongated shaft B and a head C. Shaft B includes an upper end portion 10 adapted to be grasped in a person's hands in the manner of a conventional golf club shaft, and an opposite end portion 12 attached to head C.

An elongated rod 14 has a flattened portion 16 with a suitable hole therethrough aligned with another hole in heel portion 18 of head C. Fastener means 20, such as an adjustable bolt and nut assembly, has the bolt thereof extending closely through the aligned holes in flattened portion 16 and head heel 18. The nut (not shown) of bolt and nut assembly 20 may be a wing nut so it can be readily turned without requiring tools. Bolt and nut assembly 20 may also be spring loaded as by positioning a spring between the nut and the rear surface of heel 18 in order to vary the force required to cause pivotal movement between rod 14 and head C.

An elongated pointer 22 integral with flattened portion 16 of rod 14 extends completely across the face of head C. A projection 24 on head toe 26 has suitable indicia 28 thereon for cooperation with pointer 22.

With the arrangement described included angle 30 between head sole 32 and shaft longitudinal axis 34 is variable, because head C and rod 14 can pivot relative to one another about fastener means 20.

Lower or opposite end 12 of shaft B has an elongated socket 38 therein slidably receiving rod 14. An elongated recess 40 in the outer surface of that portion of rod 14 received in socket 38 extends parallel to longitudinal axis 34. A thumb screw 42 threaded through a suitable transverse tapped hole in lower end portion 12 of shaft B has its inner screw end portion 44 received in recess 40. Cooperation between recess 40 and screw end portion 44 prevents relative rotation between shaft B and rod 14, while allowing longitudinal sliding or telescoping movement therebetween. Thumb screw 42 can be tighted for locking shaft B and rod 14 against relative telescoping movement.

A person being fitted for golf clubs holds fitting golf club A in the manner of a conventional golf club and adopts a stance for addressing a ball. In such stance, head sole 32 rests on the surface supporting the ball and also extends tangent to the bottom of the ball. With fastener means 20 sufficiently loose, angle 30 may be varied to determine the optimum club lie. Cooperation between pointer 22 and indicia 28 makes it possible to determine the optimum lie and angle 30. Indicia 28 may include indication of angles, or may simply be a plurality of vertically-spaced code symbols which are used with reference to a conversion chart for determining the optimum club lie.

While the person being fitted is in the same stance for addressing a ball, thumb screw 42 is sufficiently loose to allow relative longitudinal movement between shaft B and rod 14. This makes it possible to determine the optimum shaft length. Rod 14 includes a plurality of longitudinally-spaced indicia marks 48 which cooperate with lower end 50 of shaft B for determining shaft length. Indicia 48 on shaft 14 can directly indicate approximate shaft length, or can be a code which is used with reference to a conversion chart for determining optimum shaft length. Although widely spaced indicia 48 are shown in FIG. 1, it will be recognized that a plurality of additional minor indicia may be provided.

In the arrangement of FIG. 1 fitting golf club A is used to determine optimum qualities of variable golf club characteristics. Specifically, optimum qualities of variable characteristics of club lie and shaft length are determined. Adjustable means defined by fastener means 20 makes it possible to determine optimum club lie, and adjustable means defined by thumb screw 42 makes it possible to determine optimum shaft length. Pointer 22 and cooperating indicia 28 define indicating means for indicating club lie and angle 30. Cooperating indicia 48 on rod 14 and shaft bottom end 50 define indicating means for indicating optimum shaft length. As previously mentioned, the indicating means does not have to provide a direct determination of club lie and shaft length, and use of a conversion chart may be desirable.

The adjustable pivot connection provided by fastener means 20 may also be considered a lie adjustment means for selectively varying the club lie, and is defined by the adjustable connection. Likewise, the telescoping cooperation between rod 14 and shaft socket 38 defile a shaft adjustment means for adjusting the length of shaft B. In the arrangement shown, rod 14 forms a part of shaft B and provides the connection between shaft B and head C.

Instead of extending across face 54 of club head C, it will be recognized that pointer 22 could extend across the rear of club head C, and indicia 28 could also be on the rear surface of projection 24. Obviously, many other arrangements are also possible, including direct measurement of angle 30. Likewise, direct measurement of the adjusted length of shaft B from fastener means 20 to the upper end of shaft B is also possible.

Figure 2:
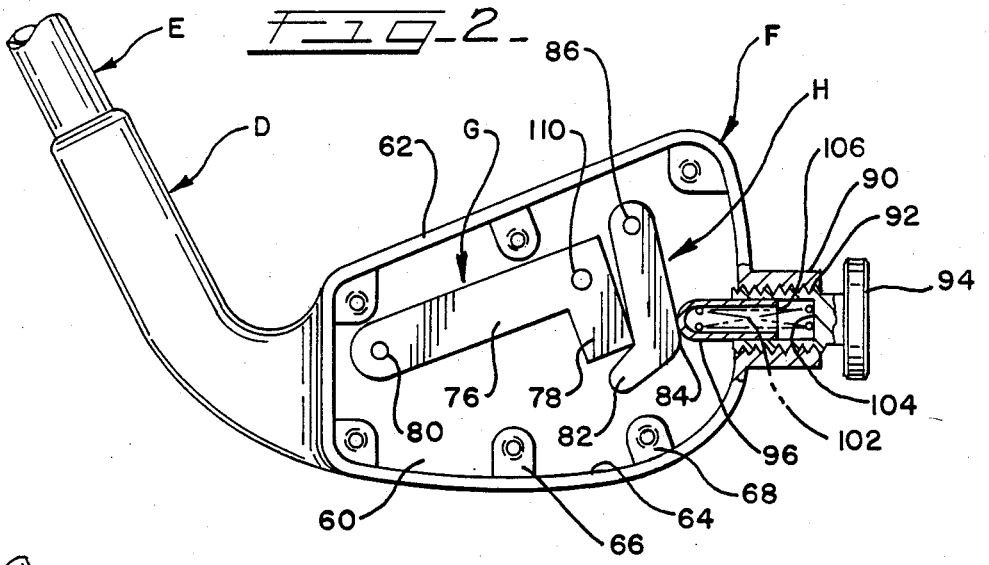
FIG. 2 is a rear elevational view of the head of another fitting golf club, and with a rear cover removed to show an internal mechanism.

FIG. 2 shows another fitting golf club D having an elongated shaft E with a head F attached to the lower end thereof. The upper end portion of shaft E is adapted to be grasped in a person's hands in the same manner as the upper end portion of shaft B in FIG. 1.

Head F includes a face plate 60 having an opposite surface from that shown in the drawing which is the face surface of head F for normally striking a ball.

Figure 4:
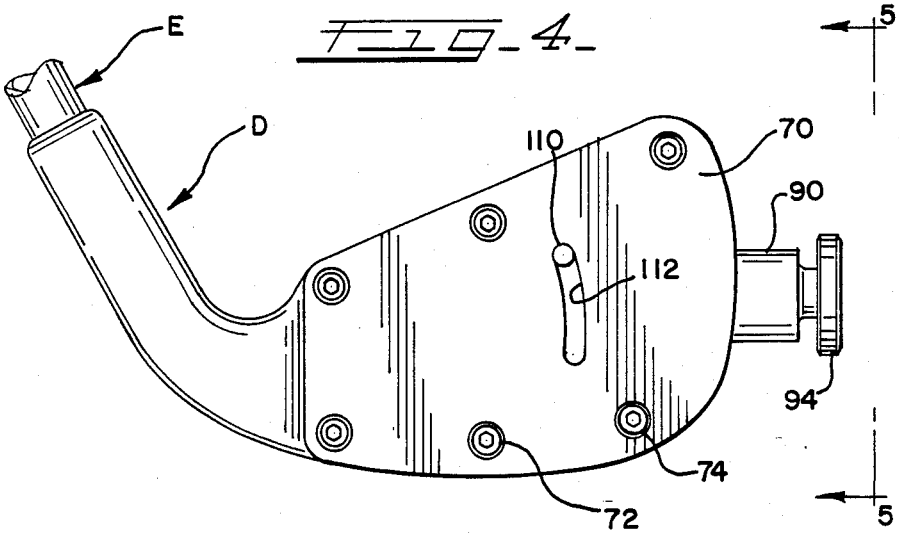
FIG. 4 is a view similar to FIGS. 2 and 3, and showing the removable cover in place.

A peripheral wall 62 extends rearwardly around the periphery of face plate 60 to define a cavity 64. A plurality of bosses having tapped holes therein are positioned around the periphery of cavity 64 and only two of such bosses are identified by numerals at 66, 68. A cover plate 70 in FIG. 4 is provided for closing cavity 64. Cover plate 70 has a plurality of holes therethrough adjacent its outer periphery aligned with the tapped holes in the cavity bosses, such as 66, 68. A plurality of screws extend through the holes in cover plate 70 into the tapped holes in the cavity bosses, such as 66, 68, for releasably securing cover plate 70 in position. Only two of the retaining screws are indicated by numerals as 72, 74.

A generally L-shaped weight G having a major leg 76 and a minor leg 78 extending perpendicular thereto is pivotally mounted within cavity 64 for swinging movement about a pivot pin 80. A releasable cam latch H having a hook portion 82 and a smoothly curved rear corner 84 is pivotally mounted within cavity 64 for swinging movement about pivot pin 86.

An internally threaded cylindrical projection 90 extends outwardly from peripheral wall 62 at the toe of club head F. An externally threaded hollow projection 92 on a thumb screw 94 is threadably received within cylindrical projection 90.

A hollow projection 96 is slidably received within thumb screw projection 92 and has a rounded nose engaging the rear surface of cam latch H. A coil spring 102 received in hollow projection 96 has one end engaging bottom 104 of the hollow interior of thumb screw projection 92, and its other end engaging the interior of projection 96 adjacent its rounded nose.

End 106 of hollow projection 96 is spaced from bottom 104 of the thumb screw interior as shown in FIG. 2. Rotation of thumb screw 94 will move bottom 104 toward or away from projection end 106, and compress or allow elongation of spring 102. This makes it possible to vary the force with which projection 96 engages the rear surface of cam latch H.

An elongated pin 110 extends outwardly from weight G adjacent the intersections of major and minor legs 76, 78. Pin 110 extends through an arcuate slot 112 in cover 70 as shown in FIG. 4. When pin 110 is at the upper end of slot 112 as shown in FIG. 4, weight G is in its armed position. Latch hook portion 82 is engaging the end of weight minor leg 78 to hold same in the position shown in FIG. 2 under the biasing force of spring 102 acting on projection 96.

Figure 3:
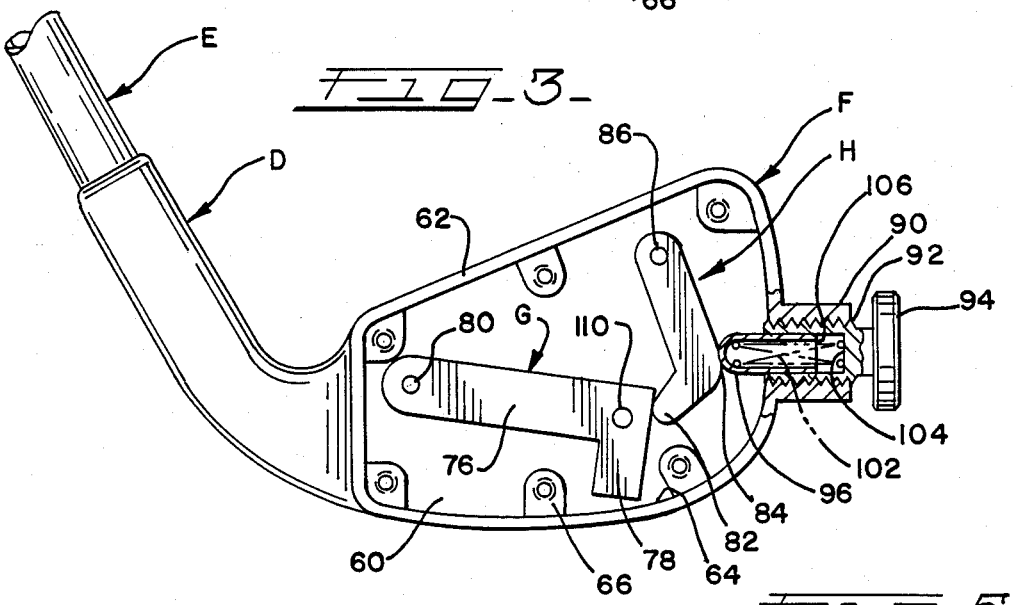
FIG. 3 is a view similar to FIG. 2, and showing the internal mechanism in a released position.

A person grasps fitting golf club D and swings same in the manner of an ordinary golf club. Centrifugal force acting on weight G will cause same to pivot clockwise about pivot pin 80 while camming latch H counterclockwise about its pivot pin 86 against the biasing force of spring 102. The leg 78 of weight G will ride past the latch hook portion 82 to the position shown in FIG. 3 wherein pin 110 will be at the bottom of arcuate slot 112 in cover plate 70. The leg 78 will then be below portion 82 of latch H as shown in FIG. 3.

The mechanism can be reset by pushing on pin 110 for pivoting weight G counterclockwise about its pivot pin 80. This will allow cam latch H to pivot clockwise about its pivot pin 86 until the leg 78 is again above hook portion 82 as shown in FIG 2. The mechanism is thereby returned to its armed position.

The centrifugal force acting on weight 76 is proportional to the swing speed of club D. The magnitude of the centrifugal force required for moving weight 76 from its armed position to its released position depends upon the adjusted position of thumb screw 94 and the force of spring 102 acting on the rear surface of cam latch H. Thumb screw 94 can be adjusted, and the person can take a plurality of swings, to determine the point at which weight G will move from its armed position to its released position.

Figure 5:
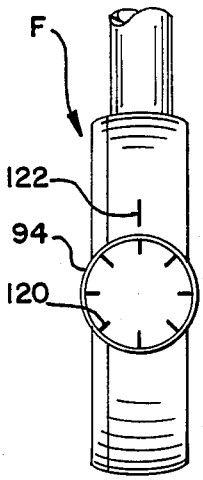
FIG. 5 is an end elevational view taken generally on line 5—5 of FIG. 4.

Circumferentially-spaced indicia 120 on the exterior of thumb screw 94, as shown in FIG. 5 cooperates with indicia 122 on the toe of club F for determining swing speed. By way of example, indicia 120 on thumb screw 94 can be numbered 1 through 8. When the mechanism moves from its armed position to its released position, the number on thumb screw 94 which is aligned with club head indicia 122 is used for referring to a conversion chart identifying an optimum shaft flex for that given number. That is, the determination need not be one of exact swing speed but a value proportional thereto for determining optimum shaft flex.

The variable golf club characteristic whose optimum quality is determined with the fitting golf club of FIGS. 2–5 is shaft flex. Movable weight G is yieldably held in its armed position by a yieldable means defined by cam latch H acting under the influence of the biasing spring. The adjustment means defined by thumb screw 94 makes it possible to vary the magnitude of the centrifugal force required for moving weight G from its armed position to its released position.

Indicating means 120, 122 determine a value proportional to swing speed for determining optimum shaft flex. When it is said that swing speed is determined, it does not necessarily mean that the actual angular velocity of the club head is determined. Instead, it can mean that a conversion chart for indicating optimum shaft flex has built into it the swing speed for the value indicated by indicia 120 on thumb screw 94. The mechanism mounted within head F may be considered a swing speed for determining means for determining the approximate speed at which the club is swung. The different swing speed values built into the different shaft flex values in a conversion chart make it possible to pick the optimum flex from the values shown by the indicating means. Eight different indicia values 120 on thumb screw 94 can simply correspond to eight different shaft flexibilities. However, each different shaft flex is optimum for a particular range of swing speeds, and obtaining a number corresponding to an optimum shaft flex for a given swing speed is the same as determining such speed.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A fitting golf club for determining the flexibility of a golf club shaft, said fitting golf club including an elongated shaft having one shaft end portion adapted to be grasped in a person's hands and an opposite shaft end portion, a fitting golf club head attached to said opposite shaft end portion, and adjustable means on said golf club head adjustable between a plurality of different positions, indicia for determining a particular position of adjustment, and mechanisms associated with said adjustable means operative responsive to the centrifugal force applied upon swinging of the fitting golf club, said mechanisms including a weight pivotally mounted within said head on an axis perpendicular to said shaft and parallel with the swing direction, said weight being movable between an armed position adjacent the upper side of said head to a released position adjacent the lower side of said head, the optimum shaft flexibility for said person being determinable by comparison of the release of said weight with the position of adjustment of said adjustable means.

2. A golf club in accordance with claim 1 wherein said yieldable means comprises a latch pivotally mounted within said head on an axis parallel with the pivot axis of said weight, said latch engaging said weight to normally hold the weight in the armed position, a spring means engaging said latch whereby in response to said centrifugal force said weight moves said latch in opposition to said spring means whereby said weight is released for movement to said released position.

3. A golf club in accordance with claim 2 wherein said adjustable means is connected to said spring means for thereby varying the amount of centrifugal force required to release said weight.

4. A golf club in accordance with claim 3 wherein said adjustable means comprises a screw head mounted on the exterior of said club head and displaying indicia, and adjacent indicia displayed on said club head so that the position of adjustment can be determined.

5. A golf club in accordance with claim 3 including a resetting pin accessible from the exterior of said club head, said pin being attached to said weight and being manually engageable for moving said weight from said released position back to said armed position in opposition to said spring means.

* * * * *